US011622634B2

(12) United States Patent
Wang

(10) Patent No.: US 11,622,634 B2
(45) Date of Patent: Apr. 11, 2023

(54) AIR-CONDITIONED MATTRESS

(71) Applicant: DONG GUAN ACONIC FABRIC CO., LTD, Guangdong (CN)

(72) Inventor: Yao-I Wang, Changhua (TW)

(73) Assignee: DONG GUAN ACONIC FABRIC CO., LTD., Dongguan (CN)

( * ) Notice: Subject to any disclaimer, the term of this patent is extended or adjusted under 35 U.S.C. 154(b) by 398 days.

(21) Appl. No.: 15/928,755

(22) Filed: Mar. 22, 2018

(65) Prior Publication Data

US 2018/0271300 A1 Sep. 27, 2018

(30) Foreign Application Priority Data

Mar. 22, 2017 (TW) ..... 106204039

(51) Int. Cl.

| | |
|---|---|
| ***A47C 21/04*** | (2006.01) |
| ***A61G 7/057*** | (2006.01) |
| ***A47C 27/00*** | (2006.01) |
| ***A47C 27/12*** | (2006.01) |

(52) U.S. Cl.

CPC ..... *A47C 21/044* (2013.01); *A47C 27/002* (2013.01); *A47C 27/121* (2013.01); *A61G 7/05784* (2016.11)

(58) Field of Classification Search

CPC ... A47C 21/044; A47C 27/121; A47C 27/002; A47C 27/00; A47C 21/048; A47C 21/042; A61G 7/05784

USPC ..... 5/423

See application file for complete search history.

(56) References Cited

U.S. PATENT DOCUMENTS

| | | | | | |
|---|---|---|---|---|---|
| 96,989 | A * | 11/1869 | Sones | A47C 21/044 | 126/210 |
| 1,142,876 | A * | 6/1915 | Davis et al. | A47C 21/048 | 5/284 |
| 2,194,569 | A * | 3/1940 | Rumpf | A47C 27/20 | 5/717 |
| 2,462,984 | A * | 3/1949 | Maddison | A47C 21/044 | 5/423 |
| 2,493,067 | A * | 1/1950 | Goldsmith | A47C 21/048 | 219/217 |
| 2,573,455 | A * | 10/1951 | Koontz | H05B 1/02 | 160/330 |
| 2,808,595 | A * | 10/1957 | McLean | A47C 17/161 | 5/43 |
| 2,878,153 | A * | 3/1959 | Hacklander | B29C 66/00 | 264/DIG. 28 |

(Continued)

*Primary Examiner* — David R Hare
*Assistant Examiner* — Luke Hall
(74) *Attorney, Agent, or Firm* — Muncy, Geissler, Olds & Lowe, P.C.

(57) ABSTRACT

An air-conditioned mattress includes a mat device, a cover device, and an air-conditioning device. The mat device includes a first mat configured as a three-dimensional structure made from a plurality of elastic thermoplastic filaments that are randomly tangled with each other. The thermoplastic filaments are fixedly connected at contact portions of the thermoplastic filaments in a way that through holes are formed at non-contact portions of the thermoplastic filaments. The cover device covers the mat device and contacts the top surface of the first mat, and the first mat is more air-permeable than the cover device. The air-conditioning device is disposed inside or outside the mat device and provides heated air flow or cooled air flow into the first mat.

5 Claims, 9 Drawing Sheets

(56) References Cited

U.S. PATENT DOCUMENTS 3,019,456 A * 2/1962 Kamp ..... A47C 31/105 5/699
3,145,837 A * 8/1964 Hornacek ..... B65D 81/113 206/594
3,156,965 A * 11/1964 Howard ..... D04H 18/02 15/210.1
3,869,739 A * 3/1975 Klein ..... A47C 27/20 5/718
4,847,933 A * 7/1989 Bedford ..... A61G 5/1043 5/652.2
5,125,238 A * 6/1992 Ragan ..... A61F 7/0097 607/113
5,160,517 A * 11/1992 Hicks ..... F24F 8/10 5/423
5,265,599 A * 11/1993 Stephenson ..... A61F 7/0097 165/46
5,336,250 A * 8/1994 Augustine ..... A47G 9/0215 5/423
5,408,711 A * 4/1995 McClelland ..... A47C 21/046 297/452.47
5,561,875 A * 10/1996 Graebe ..... A61G 5/1043 297/180.13
5,584,084 A * 12/1996 Klearman ..... A61G 7/05769 403/2
5,640,727 A * 6/1997 Kappel ..... A47G 9/0215 5/423
5,715,695 A * 2/1998 Lord ..... B60H 1/00285 297/180.1
5,792,216 A * 8/1998 Kappel ..... A61F 7/0097 5/423
5,794,289 A * 8/1998 Wortman ..... A61G 7/001 5/423
5,817,146 A * 10/1998 Augustine ..... A61F 7/0053 607/104
5,817,147 A * 10/1998 Wolf ..... A61F 7/00 607/104
5,890,243 A * 4/1999 Dickerhoff ..... A47G 9/0215 5/423
6,224,150 B1 * 5/2001 Eksin ..... B60N 2/5635 297/180.12
6,263,530 B1 * 7/2001 Feher ..... A47C 7/74 165/185
6,269,504 B1 * 8/2001 Romano ..... A47C 27/20 5/653
6,347,423 B1 * 2/2002 Stumpf ..... A47C 27/064 5/655.9
6,493,889 B2 * 12/2002 Kocurek ..... A47G 9/0215 5/423
7,290,300 B1 * 11/2007 Khambete ..... A47C 7/74 297/180.13
8,065,763 B2 * 11/2011 Brykalski ..... A47C 21/044 5/652.2
8,181,290 B2 * 5/2012 Brykalski ..... A61G 7/05 5/652.2
8,191,187 B2 * 6/2012 Brykalski ..... A47C 21/044 607/104
8,261,388 B1 * 9/2012 Gill ..... A61G 7/05776 5/713
8,359,684 B2 * 1/2013 Yoon ..... A47C 21/048 5/423
8,388,057 B2 * 3/2013 Barkow ..... A47C 7/74 297/180.14
8,407,835 B1 * 4/2013 Connor ..... A47C 29/003 5/309
8,539,624 B2 * 9/2013 Terech ..... A47C 7/74 5/652.1
8,555,440 B2 * 10/2013 Lewis ..... A61F 7/00 5/713
8,745,784 B2 * 6/2014 Cole ..... A47C 27/082 5/423
8,881,328 B2 * 11/2014 Mikkelsen ..... A47C 21/044 5/652.2
8,955,337 B2 * 2/2015 Parish ..... F24F 5/0096 62/3.4
9,021,639 B1 * 5/2015 Lin ..... A47C 27/148 5/727
9,125,497 B2 * 9/2015 Brykalski ..... A47C 21/048
2002/0078507 A1 * 6/2002 Pearce ..... A47C 27/084 5/636
2003/0019044 A1 * 1/2003 Larsson ..... A47C 31/007 5/724
2003/0160479 A1 * 8/2003 Minuth ..... B60N 2/5635 297/180.14
2003/0230913 A1 * 12/2003 Buss ..... B60N 2/5642 297/180.14
2004/0189061 A1 * 9/2004 Hartwich ..... B60N 2/5635 297/180.13
2006/0080778 A1 * 4/2006 Chambers ..... A47C 21/044 5/652.2
2008/0028533 A1 * 2/2008 Stacy ..... A61G 7/015 5/713
2009/0013470 A1 * 1/2009 Richards ..... G16Z 99/00 5/613
2009/0134675 A1 * 5/2009 Pfahler ..... B60N 2/5635 454/120
2010/0287708 A1 * 11/2010 Shelby ..... A47C 27/121 5/737
2012/0042452 A1 * 2/2012 Takaoka ..... A47C 31/006 5/691
2014/0201925 A1 * 7/2014 Tursi, Jr. ..... A47C 27/14 5/722
2016/0066700 A1 * 3/2016 Lin ..... A47C 27/121 5/652.1

* cited by examiner

AIR-CONDITIONED MATTRESS

BACKGROUND OF THE INVENTION

1. Field of the Invention

The present invention relates to the bed defined in International Patent Classification NO. A47C, and more particularly to a mattress equipped with an air-conditioning device.

2. Description of the Related Art

A traditional mattress only has the functions of supporting and keeping warm. It is unable to directly provide cool air or warm air to the user when the weather is hot or cold, and is thereby relatively uncomfortable in usage.

Japan Patent Publication No. 2005-168261 disclosed a mattress having air-conditioning function, the air-conditioning device 1 of which is disposed outside of the bedding 2, 3 for providing warm air to the bedding 2, 3. Besides, China Patent No. CN200980494Y disclosed another mattress having air-conditioning function, which has an evaporator 21 and a condenser 18 disposed under a mattress panel 1, and the mattress panel 1 is controlled in temperature thereof by means of a hard board 4, a foam sponge board 3 and a textile surface layer 2.

However, as to the design of the bedding or mattress in the above-mentioned patent, the air flow produced by the air-conditioning device is usually obstructed by the inner material of the bedding or mattress, so that the air flow is unable to be transmitted to the user fast and effectively, lowering the extent that the user experiences the air flow. Besides, the mattress panel in the above-mentioned patent uses a foam sponge board which provides a relatively worse supporting function. The elderly and the people ill in the lumbar region usually need the mattress with better supporting function. Therefore, a mattress with high transmitting air flow speed and good supporting for the user is required.

SUMMARY OF THE INVENTION

The present invention is an improvement in view of the above-mentioned disadvantages of the traditional mattress, by providing an air-conditioned mattress which includes a mat device, a cover device, and an air-conditioning device. The mat device includes a first mat configured as a three-dimensional structure made from a plurality of elastic thermoplastic filaments that are randomly angled with each other. The aforesaid thermoplastic filaments are fixedly connected at contact portions of the thermoplastic cords in a way that a plurality of through holes are formed at non-contact portions of the thermoplastic filaments. The cover device covers the mat device and contacts at least a top surface of the first mat, and the mat is more air-permeable than the cover device. The air-conditioning device is disposed inside or outside the mat device and provides heated air flow or cooled air flow into the first mat.

By the aforesaid design of the mattress and the characteristics of the first mat being made by the three-dimensional structure which is made from a plurality of elastic thermoplastic filaments, the three-dimensional structure provides a larger number of through holes and has the characteristics of good supporting function, high porosity and high air-permeability. Thus, when the heated air flow or cooled air flow is transmitted from the air-conditioning device to the first mat, the air flow can spread in the first mat quickly and evenly, thereby the air flow can be transmitted to the user at high speed, and the mattress provides a good supporting surface to the user.

In an aspect, the mat device of the mattress of the present invention structurally includes a second mat which is disposed under the first mat and made of porous material. Preferably, the structure and material of the second mat may be the same with those of the first mat, so that the second mat can have higher porosity and air-permeability, like the first mat. If the air-conditioning device is disposed inside the second mat, the air-conditioning device can extract sufficient air through lateral surfaces of the second mat, thereby preventing the air-conditioning device from overheating caused by bad dissipation after a long period of using.

In another aspect, a layer of middle mat may be disposed between the first mat and the second mat. The middle mat is preferably made of the material whose elasticity is lower than the elasticity of the second mat for improving the supporting function of the whole mattress.

In another aspect, the mattress may have no such second mat and middle mat, and the air-conditioning device may be disposed inside the first mat.

DETAILED DESCRIPTION OF THE INVENTION

Figure 1:
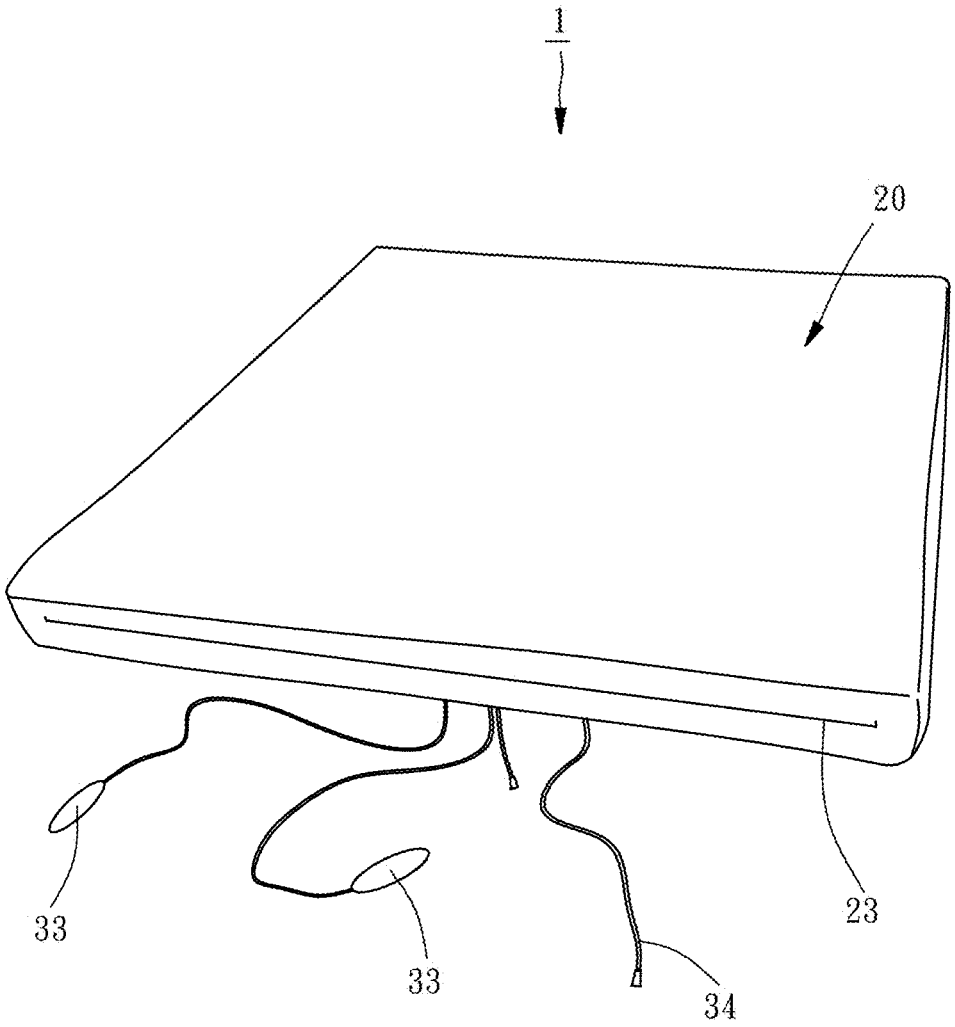
FIG. 1 is a perspective view of a mattress according to a first embodiment of the present invention.

The technical features of the present invention will be specified in the following description of embodiments and the accompanying drawings. For the convenience of recognition, same reference numerals used in the following embodiments designate same or similar elements. The present invention provides an air-conditioned mattress 1 which primarily includes a mat device 10, a cover device 20, and two air-conditioning devices 30.

Figure 2:
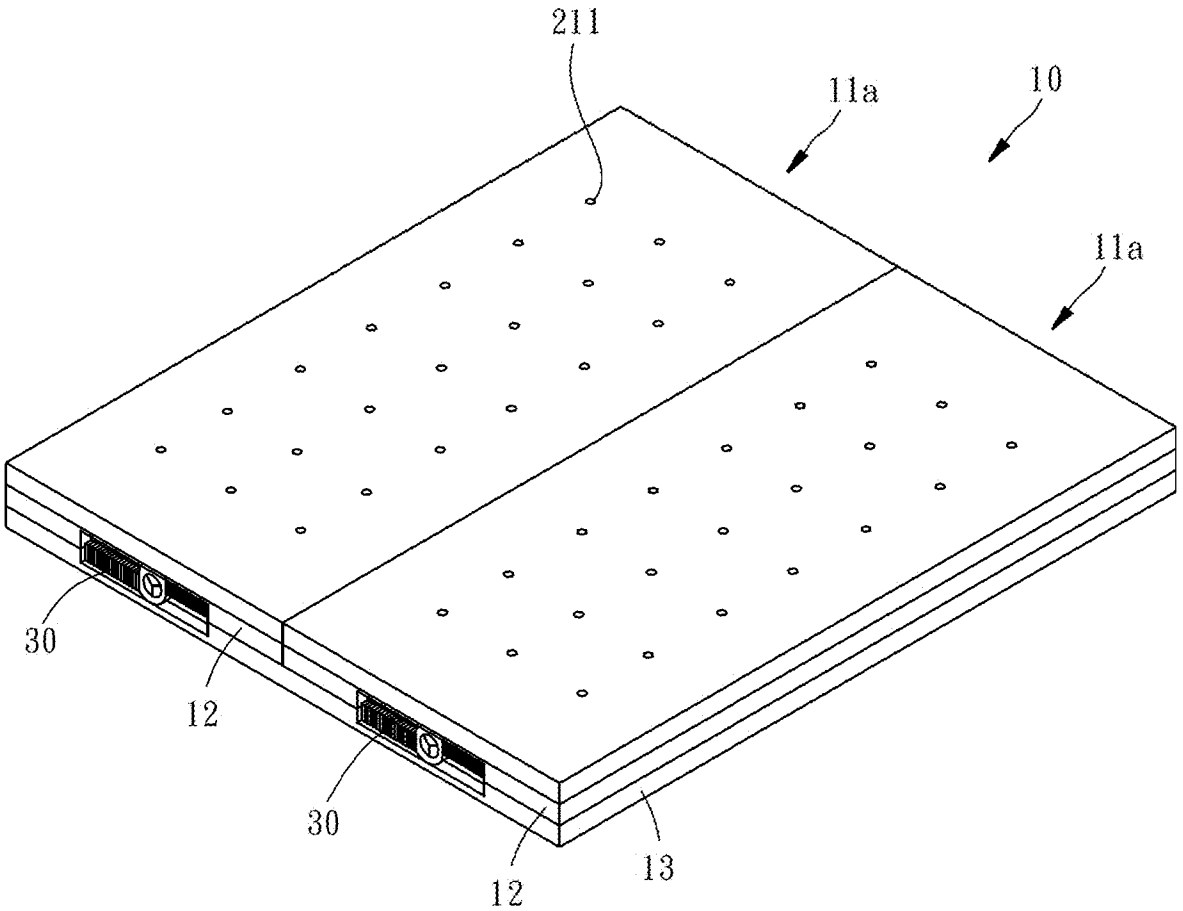
FIG. 2 is similar to FIG. 1, showing the status that a cover device of the mattress is removed and the mattress is for a double bed.
Figure 5:
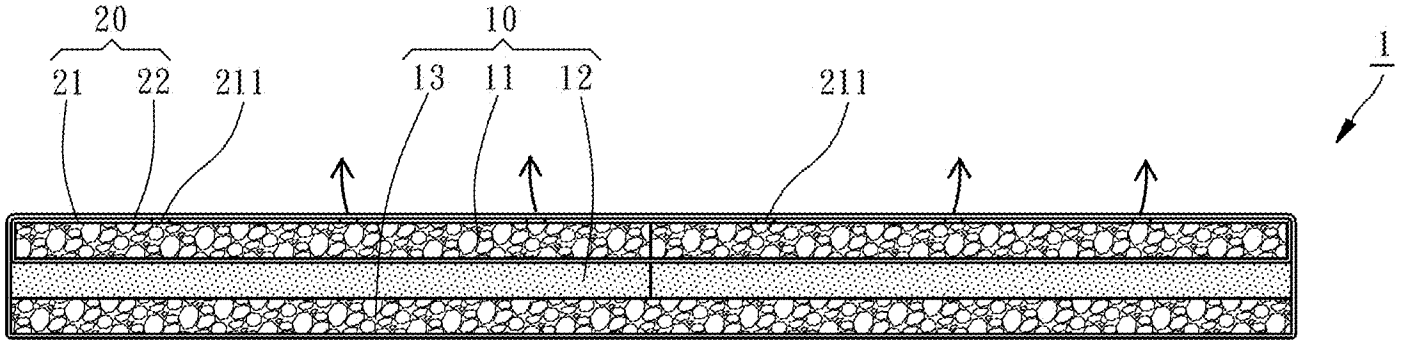
FIG. 5 is a sectional view of the mattress according to the first embodiment of the present invention, showing the case that the mat units are covered by the same first cover.

Referring to FIGS. 1, 2 and 5, the mat device 10 includes two first mats 11, two middle mats 12, and a second mat 13.

Figure 3:
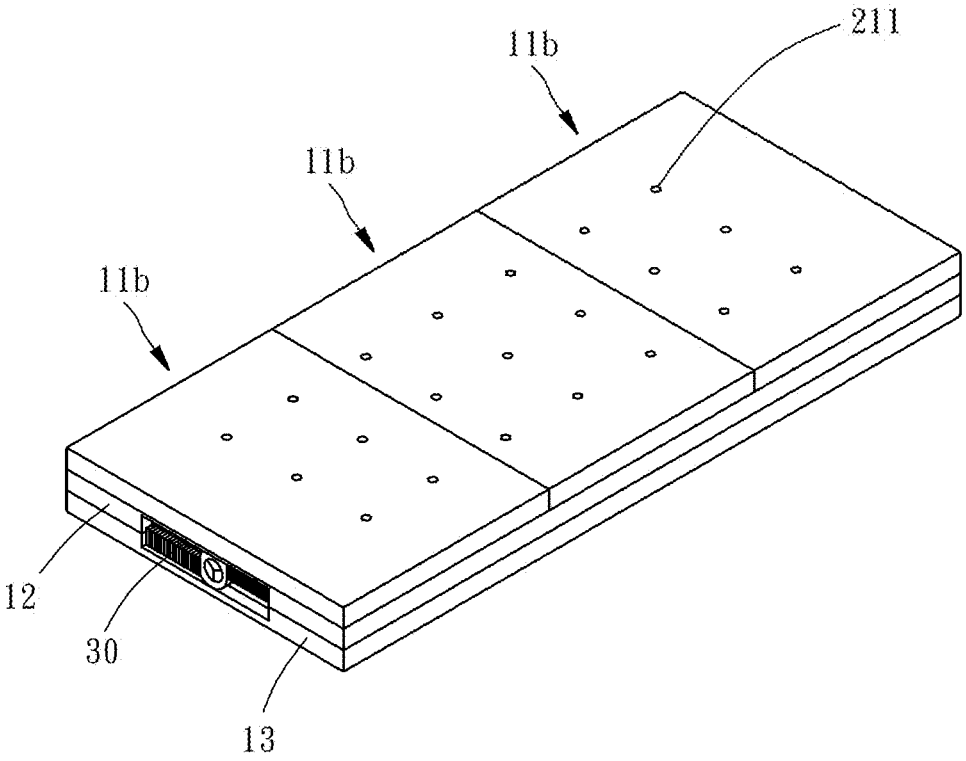
FIG. 3 is similar to FIG. 2, showing the case that the mattress is for a single bed.
Figure 4:
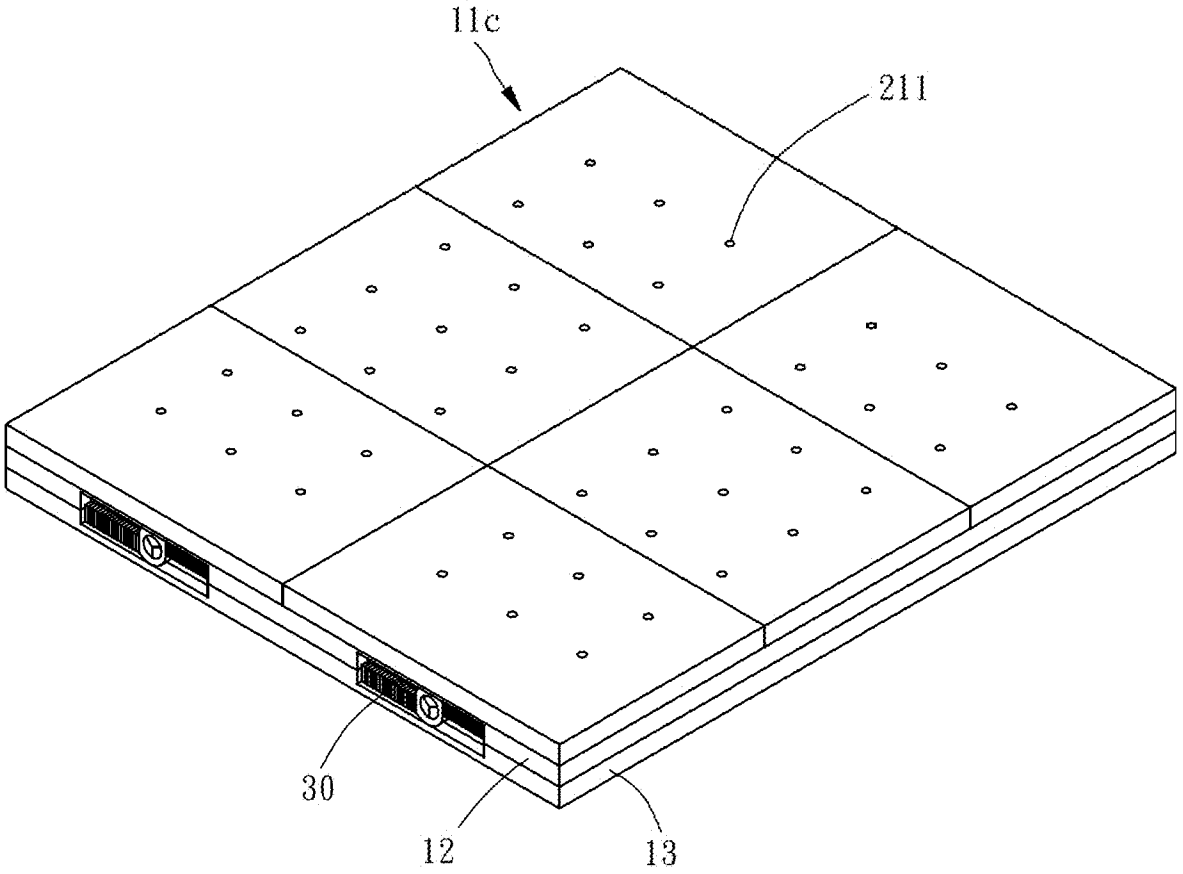
FIG. 4 is similar to FIG. 2, showing the case that the mattress is for a double bed and a first mat is composed of six mat units.

The first mat 11 is a three-dimensional net-like structure 15 made of elastic thermoplastic material such as polyethylene. The thermoplastic material has a characteristic that the expansion ratio increases with the shear rate. Specifically, the first mat 11 is manufactured by putting the molten thermoplastic material into an extrusion machine, utilizing the extruder to extrude a plurality of thermoplastic filaments 16, and making the aforesaid thermoplastic filaments 16 be randomly tangled and in contact with each other, so that the molten thermoplastic filaments 16 can be harden and shaped in a three dimensional structure 15. The thermoplastic filaments 16 are interlaced in a sparse and dense arrangement and equipped with very high elasticity. The aforesaid thermoplastic filaments 16 may be solid or hollow cords. The plurality of thermoplastic filaments 16 are fixedly connected at contact portions 17 of the thermoplastic filaments 16 in a way that through holes are formed at non-contact portions 18 of the thermoplastic filaments 16. Such structure made of such thermoplastic material can provide good supporting function, and the whole three-dimensional structure 15 is provided therein with a large number of through holes and a very high porosity. Therefore, air flow can effectively circulate in the three-dimensional structure 15, so that the three-dimensional structure 15 has high air-permeability. The first mat 11 in the present invention is a combination type of mat. In the present embodiment, the mattress 1 is illustrated by a double bed, the first mat 11 consists of two identical mat units, i.e. the left mat 11*a*1 and the right mat 11*a*2 as shown in FIG. 2. Each of the mat units 11*a* has a characteristic of quickly drying after being washed and less possibility of deformation, so the mat units 11*a* can be separately taken out and washed. In another embodiment as shown in FIG. 3, the mattress is illustrated by a single bed, and the first mat 11 consists of three mat units, i.e. three identical mat units 11*b*1-11*b*3. The mat units 11*b*1,11*b*2, 11*b*3 correspond in position to the head, body and feet of the user respectively, allowing the user to easily take out the desired mat unit to wash. In another embodiment as shown in FIG. 4, the mattress is illustrated by a double bed, and the first mat 11 consists of six mat units, i.e. the six identical mat units 11*c*1-11*c*6. The six mat units 11*c*1-11*c*6 are arranged in a three by two array. In another embodiment (not shown), a plurality of mat units are buckled by a plurality of buckling members for positioning the mat units and lowering the noise resulting from the friction between the mat units.

Besides, the middle mats 12 and the second mat 13 are disposed under the first mats 11. The middle mats 12 are located between the first mats 11 and the second mat 13. The material and structure of the second mat 13 are the same with those of the first mat 11. The middle mats 12 may be made of porous material such as polyurethane (PU). Alternately, the material and structure of the middle mat 12 may be the same with those of the first mat 11. The middle mat 12 is used for providing the supporting function and fixing an air discharging duct 32 of the air-conditioning device 30. The porosity of the first mat 11 is higher than the porosity of the middle mat 12. Besides, the elasticity of the first mat 11 is higher than the elasticity of the middle mat 12. Therefore, the first mat 11 is more liable to deform by the press of human body. The middle mat 12 is less likely to deform by the press, thereby more supportive and firmer. Each of the first mats 11, middle mats 12 and second mat 13 may be provided with a thickness larger than 3 centimeters for providing better supporting function. In the present embodiment, the first mat 11, the middle mat 12 and the second mat 13 are all about 5 centimeters (cm) thick. Especially the first mat 11 is mainly relied, which is closest to the human body. Therefore, such thickness gives the mattress a good supporting which allows the elderly and people ill in the lumbar region to get up from the mattress much more easily. The first mat 11 and the second mat 13 both have a density of 50 $kg/m^3$.

In this embodiment, either the first mats 11 or the middle mats 12 are arranged side by side (from left to right). The mattress in this embodiment overall has two first mats 11, two middle mats 12 and a second mat 13, which gives this type of mattress combination better stability. It should be mentioned that unlimited amount of the middle mats 12 and the second mat 13 may be provided to the mattress. In the following embodiments, the mat device 10 may be composed of only the first mat 11 and the middle mat 12, or only the first mat 11 and the second mat 13. The mat device 10 may even have no such middle mat 12 or second mat 13. Alternatively, the mat device 10 may include a plurality of first mat 11, a middle mat 12 and a plurality of second mats 13.

Referring to FIG. 5, the cover device 20 covers the mat device 10 and contacts at least the top surface of the first mat 11. The cover device 20 is located on the exterior surfaces of the mat device 10. The cover device 20 includes a first cover 21 and a second cover 22.

Figure 6:
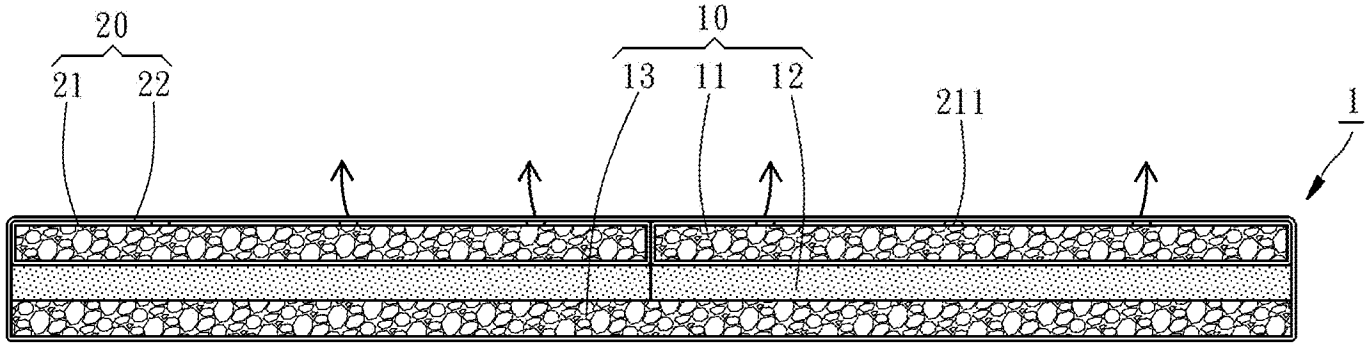
FIG. 6 is similar to FIG. 5, showing the case that each mat unit is covered by a first cover individually.
Figure 7:
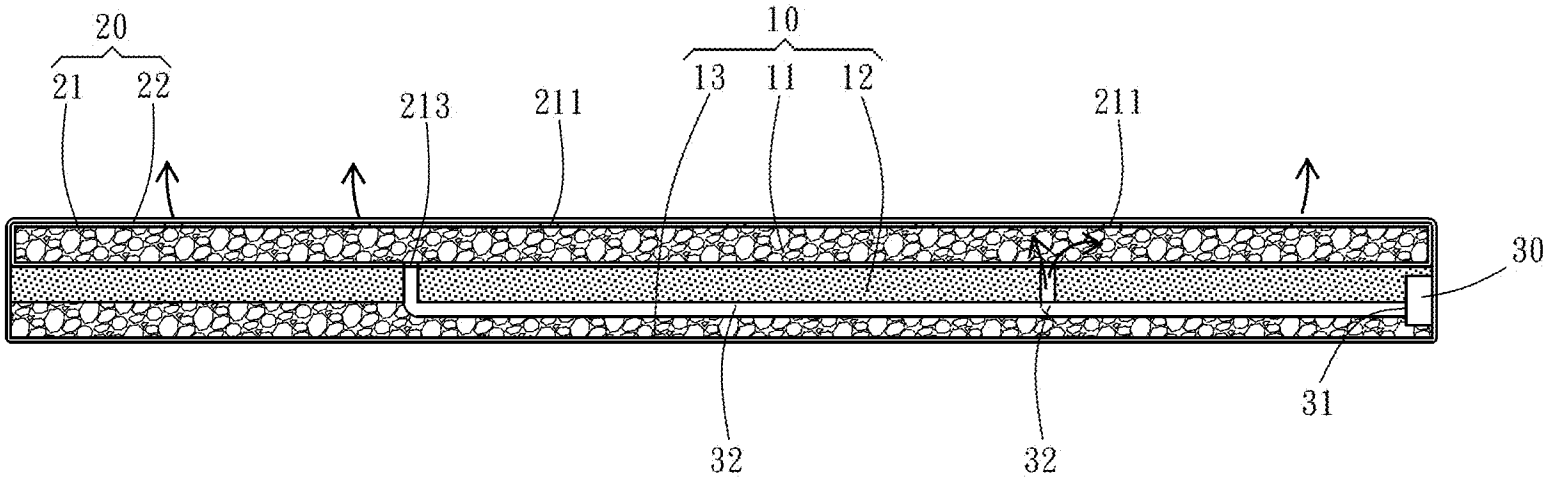
FIG. 7 is another sectional view of the mattress according to the first embodiment of the present invention, taken from different angle from FIG. 5.

Owing that the first mat 11 in the present invention is a three-dimensional net structure which is made by thermoplastic filaments, it is relatively more uncomfortable to the skin. Therefore, to deal with the abovementioned problem, the first cover 21 in this embodiment is used to cover and contact the first mat 11 to prevent the user from directly contacting the first mat 11. However, owing that there is only one such cover device 20 that is added between the user and the first mat 11, the cooled or heated air flow can be less obstructed and quickly sensed by the user. In the first embodiment, the first cover 21 covers all exterior surfaces of all mat units 11*a*, as shown in FIG. 5. In another embodiment as shown in FIG. 6, each of the mat units 11*a* is covered by a first cover 21. The first cover 21 is provided on the top surface thereof with a plurality of air-permeable holes 211, and provided on the bottom surface thereof with a plurality of openings 213 as shown in FIG. 7. The amount of the opening 213 may be increased or decreased, and may be decreased to only one. The air-permeable holes 211 are used for discharging the air in the first mat 11 and preventing foreign objects from entering the first mat 11. The first cover 21 may be made of mutispandex, non-woven fabric, 3D air-permeable mesh, blended fabric, or cotton. The material of the first cover 21 may be anyone of polyethylene (PE), polyethylene terephthalate, nylon, polyurethane (PU), thermoplastic elastomer (TPE), thermoplastic polyurethane (TPU), other natural material, or a blend of the aforesaid materials. The first cover 11 is denser and less air-permeable. The first mat 11 is more air-permeable than the first cover 21.

The second cover 22 covers the first mats 11, the middle mats 12, the second mat 13 and the air-conditioning device 30. Besides, a zipper 23 is disposed at the opening of the second cover 22 for closing the second cover 22, as shown in FIG. 1, benefitting taking out and washing the first mat 11. The material of the second cover 22 may be chosen from the above-mentioned materials of the first cover 21, but more air-permeable than the first cover 21. Likewise, the first mat 11 is more air-permeable than the second cover 22. The top surface of the mattress 1 is formed by the second cover 22 of the cover device 20, so that the air flow in the first mats 11 can upwardly flow out of the mattress 1 through the air-permeable holes 211 of the first cover 21 and the second cover 22.

Referring to FIG. 7, the air-conditioning device 30 is substantially a cool-and-hot air machine (referred as air-conditioning device in the following content). The mattress has two air-conditioning devices 30, which has a plurality of air outlets 31 and air discharging ducts 32, two controllers 33 and a set of power cord 34, as shown in FIG. 1. The air-conditioning device 30 is disposed in the second mat 13. Preferably, the air-conditioning device 30 is disposed between the second mat 13 and the middle mat 12. For lowering the disturbance of the noise, which is caused by the operation of the air-conditioning device, to the user when the user is taking a rest, the air-conditioning device 30 is disposed away from the position corresponding to the head of the user. On the other hand, the heat produced by the operating air-conditioning device 30 can warm up the user, so the air-conditioning device 30 is preferably arranged between the second mat 13 and the middle mat 12 and located at a lateral surface, as shown in FIG. 2. This embodiment takes the mattress for a double bed as an example, the two air-conditioning devices 30 are located at the lateral surface of the second mat 13 adjacent to the feet of the user. Therefore, there are two independent systems for controlling the air-conditioning devices 30. In another embodiment (not shown), the air-conditioning device 30 may be arranged at the bottom of the second mat 13 in a way that the discharging duct 32 penetrates through the middle mat 12, and two ends of the air discharging duct 32 are connected with the air outlet 31 and the opening 213 of the first cover 21 respectively, so that the cooled or heated air flow produced by the air-conditioning device 30 can be transmitted into the first mat 11 through the air discharging duct 32. In consideration of the problem that the air-conditioning device 30 may be needed to clean the dander or the dust after a long period of using, the air-conditioning device 30 in another embodiment (not shown) may be detachable, and the first cover 21 or the second cover 22 may be provided with an opening corresponding to the air-conditioning device 30.

By the aforesaid structural design of the mattress 1 and the characteristics of the first mat 11 being made of material and structure with higher porosity, the air flow transmitted from the air-conditioning device 30 into the first mat 11 can spread in the first mat 11 evenly. Besides, the air flow is limited by the denser first cover 21, thereby uneasily leaked from the lateral surfaces of the first mat 11, so that the air flow can be guided upwardly to flow out of the mattress 1, and the whole mattress 1 functions similarly to the air cushion bed.

On the other hand, because the second mat 13 and the second cover 22 are both made of the material and structure with high air-permeability, the air-conditioning device 30 can extract sufficient air through the lateral surfaces of the second mat 13 for the producing of the cooled or heated air flow and the heat dissipation of the air-conditioning device 30, thereby preventing the air-conditioning device 30 operating for a long time from overheating. Besides, the flowing path of the air flow has an angle of 90 degrees (the air is extracted laterally and discharged upwardly), unlike the traditional mattress, the air needs to be extracted from bottom to top (i.e. in an angle of 180 degrees). Therefore, the mattress 1 of the present invention can be adapted for most commonly used bed frames. The bed frames don't need any modification, enhancing convenience in usage.

Besides, in the first embodiment, the whole air-conditioning device 30 is combined with the second mat 13, so the air-conditioning device 30 doesn't additionally occupy the space in the room, improving the convenience of usage.

Figure 8:
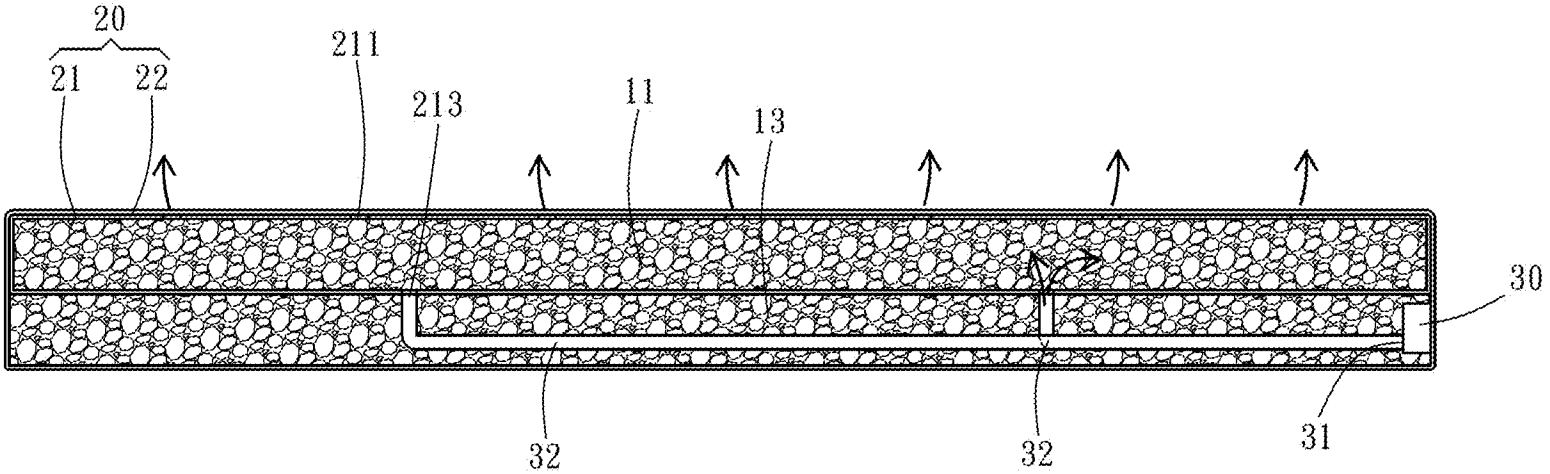
FIG. 8 is similar to FIG. 7, which is a sectional view of a mattress according to a second embodiment of the present invention.

Referring to FIG. 8, the present invention provides a second embodiment. The mattress 1 in the second embodiment is similar to the mattress in the first embodiment in structure. One of the differences between the first and second embodiments is that the mattress 1 in the second embodiment has no such middle mat 12, the first mat 11 is thus disposed on the second mat 13 with the first cover 21 located therebetween, and the air discharging duct 32 is directly connected with the opening 213, so that the thickness of the whole mattress 1 is decreased to 10 centimeters (each of the first mat 11 and the second mat 13 is 5 centimeters thick).

Figure 9:
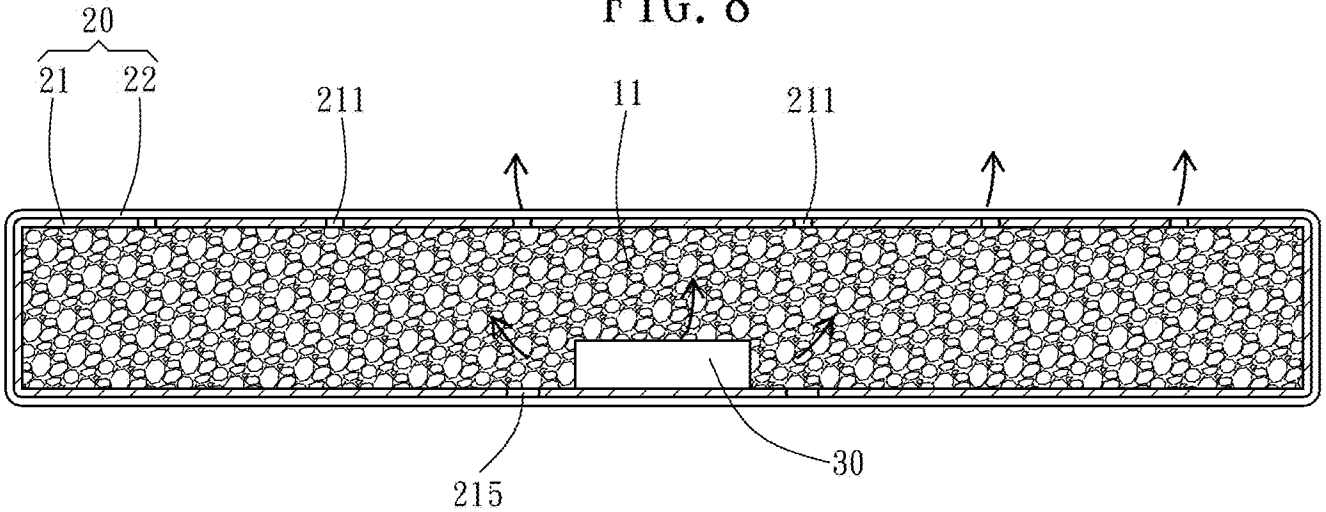
FIG. 9 is similar to FIG. 7, which is a sectional view of a mattress according to a third embodiment of the present invention.
Figure 10:
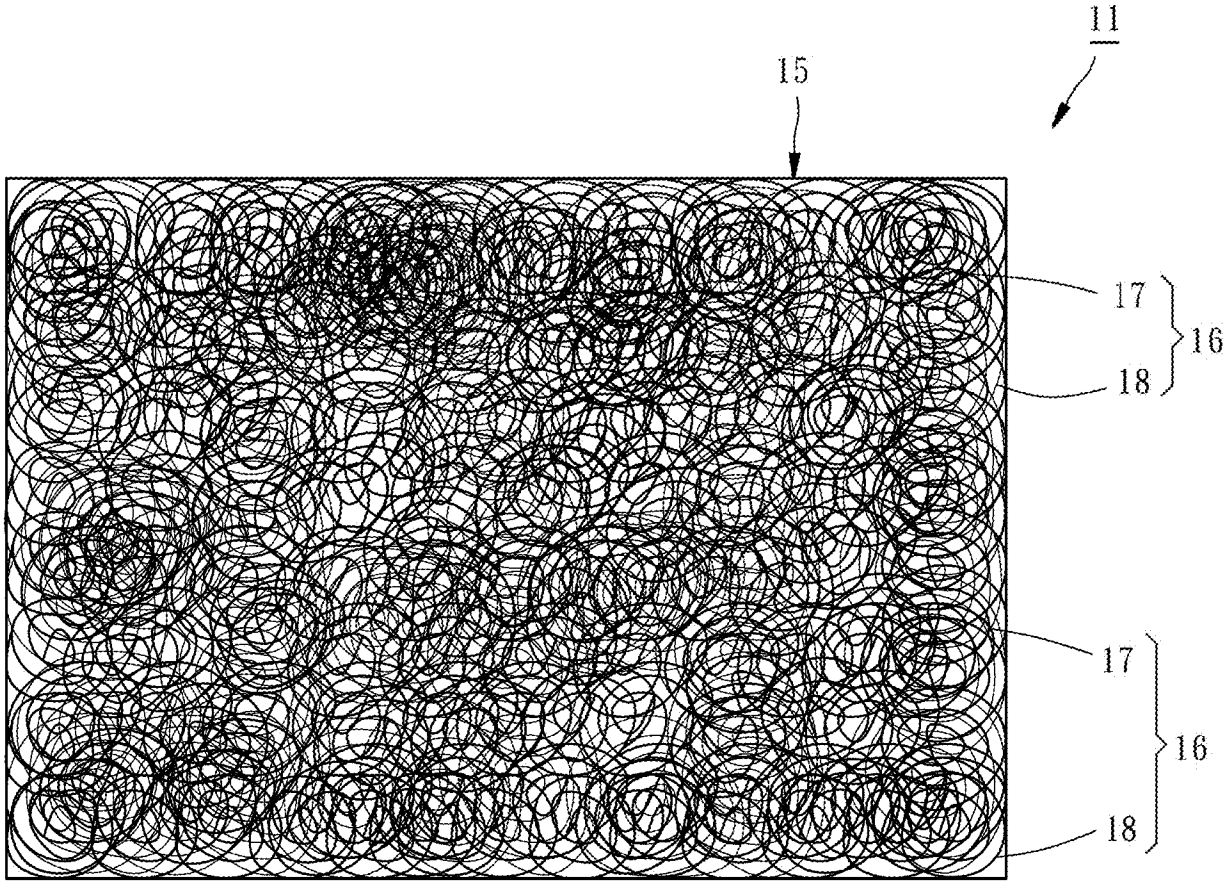
FIGS. 10-11 show the first mat of the present application.
Figure 11:
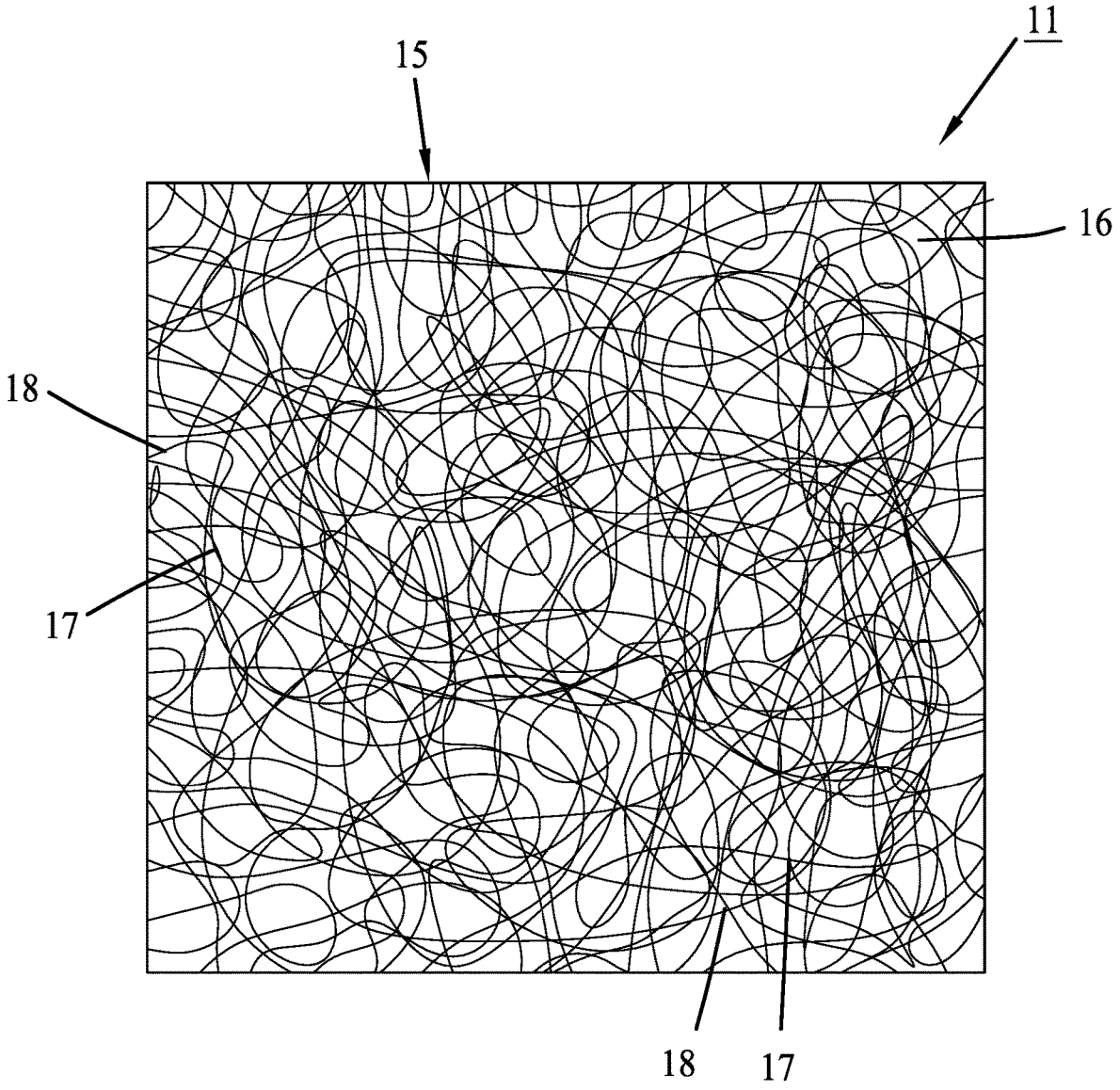

Referring to FIG. 9, the present invention provides a third embodiment. The mattress 1 in the third embodiment is also similar to the mattress in the first embodiment in structure. One of the differences between the first and third embodiments is that the mattress 1 in the third embodiment has no such middle mat 12 and second mat 13, and the air-conditioning device 30 is thus directly disposed inside the first mat 11 and discharges cooled or heated air flow upwardly. Besides, in order that the air-conditioning device 30 can extract sufficient air, the first cover 21 in the third embodiment is provided on the bottom surface thereof with a plurality of air inlets 215. It should be mentioned that the air inlets 215 may be provided on the lateral surface of the first cover 21.

The above content is only the description of the preferred embodiments of the present invention. Any variation and modification equivalent to the claims of the present invention should be included within the scope of the present invention.

What is claimed is:

1. An air-conditioned mattress comprising:

a mat device comprising a first mat configured as a three-dimensional structure made from a plurality of elastic thermoplastic filaments that are randomly tangled with each other, the thermoplastic filaments being fixedly connected at contact portions of the thermoplastic filaments in a way that a plurality of through holes are formed at non-contact portions of the thermoplastic filaments;

a cover device covering the mat device and contacting at least a top surface of the first mat, the first mat being more air-permeable than the cover device; and an air-conditioning device disposed inside the mat device and providing hot air flow or cool air flow into the first mat;

wherein the first mat has a top surface, a bottom surface, and four lateral surfaces;

wherein the cover device comprises a first cover and a second cover; the first cover covers and contacts the top surface, the bottom surface, and the four lateral surfaces of the first mat;

wherein the mat device further comprises a second mat which is located under the first mat; the air-conditioning device is disposed in the second mat;

wherein the second cover covers the first mat and the second mat, and the second cover covers the first cover, wherein the first mat is separated from the second mat via the first cover, and the first mat is sequentially adjacent to the second mat;

wherein the second cover contacts all of a bottom surface of the second mat;

wherein the first mat and the second mat both have a density of 50 $kg/m^3$.

2. The air-conditioned mattress as claimed in claim 1, wherein the air-conditioning device is disposed outside the first mat; the air-conditioning device has an air outlet and an air discharging duct; the first cover is provided on a bottom surface thereof with at least one opening; two ends of the air discharging duct are connected with the air outlet and the at least one opening respectively.

3. The air-conditioned mattress as claimed in claim 1, wherein the second mat is configured as a three-dimensional structure made from a plurality of elastic thermoplastic filaments that are randomly tangled with each other; the thermoplastic filaments are fixedly connected at contact portions of the thermoplastic filaments in a way that a plurality of through holes are formed at non-contact portions of the thermoplastic filaments.

4. The air-conditioned mattress as claimed in claim 1, wherein the first mat is 5 centimeters thick.

5. The air-conditioned mattress as claimed in claim 1, wherein the second cover is more air-permeable than the first cover.

* * * * *